United States Patent [19]

Lindblad et al.

[11] 4,002,570

[45] Jan. 11, 1977

[54] ELECTROPHOTOGRAPHIC DEVELOPER WITH POLYVINYLIDENE FLUORIDE ADDITIVE

[75] Inventors: Nero R. Lindblad, Palmyra; James M. Pearson, Webster, both of N.Y.

[73] Assignee: Xerox Corporation, Stamford, Conn.

[22] Filed: Dec. 26, 1973

[21] Appl. No.: 428,540

[52] U.S. Cl. ..... 252/62.1 P; 96/1 SD; 427/14

[51] Int. Cl.[2] ..... G03G 9/02

[58] Field of Search ..... 252/62.1; 96/1 SD; 117/17.5; 427/14

[56] References Cited

UNITED STATES PATENTS

| | | | |
|---|---|---|---|
| 2,582,327 | 1/1952 | Haine | 252/62.1 X |
| 2,890,968 | 6/1959 | Giaimo | 117/17.5 |
| 3,093,039 | 6/1963 | Rheinfrank | 96/1 SD X |
| 3,507,686 | 4/1970 | Hagenbach | 252/62.1 X |
| 3,753,910 | 8/1973 | Mitsuhashi et al. | 252/62.1 |
| 3,778,262 | 12/1973 | Queener et al. | 252/62.1 X |
| 3,798,167 | 3/1974 | Kukla et al. | 96/1 SD X |

*Primary Examiner*—Roland E. Martin, Jr.
*Attorney, Agent, or Firm*—James J. Ralabate; James H. Laughlin, Jr.

[57] ABSTRACT

An electrophotographic developer composition is provided with a lubricating component comprising particulate, cross-linked polyvinylidene fluoride. The polyvinylidene fluoride is cross-linked by exposure to a small dosage of high energy radiation.

5 Claims, No Drawings

ELECTROPHOTOGRAPHIC DEVELOPER WITH POLYVINYLIDENE FLUORIDE ADDITIVE

BACKGROUND OF THE INVENTION

This invention relates generally to developer compositions used in electrophotographic processes, and more specifically, to the incorporation of cross-linked polyvinylidene fluoride within the developer composition in order to provide improved cleaning of the photoreceptor.

Electrophotographic processes, as known within the art, generally employ an insulated photoconductive element or "photoreceptor surface" on which a latent electrostatic charge pattern or image is formed. This latent electrostatic image is rendered visible or "developed" by contacting the photoreceptor surface with a developer composition. The developed image is then transferred to paper, usually by the well known technique of electrostatic transfer.

A common method used in development of the latent electrostatic image is known as "cascade" development as disclosed in U.S. Pat. No. 2,618,552. This technique employs a multiple component developer composition including a particulate, free-flowing carrier vehicle and an electroscopic toner material. The developer composition may also be provided with a lubricating component as disclosed hereinbelow. Carrier vehicles which have been utilized with cascade development include glass beads, ammonium or sodium chloride granules, and resin coated steel shot. The toner materials used are generally made of resins or resin blends in which a pigment such as carbon black has been dispersed. The multicomponent developer is poured or "cascaded" over the photoreceptor surface whereby some of the electroscopic toner will be deposited and held on the latent image areas by the electrostatic forces present therein.

Another method of developing electrostatic images is the "magnetic brush" process as disclosed, for example, in U.S. Pat. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

Still another technique for developing elctrostatic latent images is the "powder cloud" process as disclosed, for example, by C. F. Carlson in U.S. Pat. No. 2,221,776. In this method, a developer material comprising electrically charged toner particles in a gaseous fluid is passed adjacent the surface bearing the electrostatic latent image. The toner particles are drawn by electrostatic attraction from the gas to the latent image. This process is particularly useful in continuous tone development.

Although some of the foregoing development techniques are employed commercially today, the most widely used commercial electrophotographic development technique is the technique known as "cascade" development. A general purpose office copying machine incorporating this development process is described in U.S. Pat. No. 3,301,126. In automatic electrophotographic equipment, it is conventional to employ a photoreceptor surface or xerographic plate in the form of a cylindrical drum which is continuously rotated through a cycle of sequential operations including charging, exposure, developing, transfer and cleaning. The plate is usually charged with corona of positive polarity by means of a corona generating device of the type disclosed by L. E. Walkup in U.S. Pat. No. 2,777,957 which is connected to a suitable source of high potential. After forming a powder image on the electrostatic latent image during the development step, the powder image is electrostatically transferred to a support surface by means of a corona generating device such as the corona device mentioned above. In automatic equipment employing a rotating drum, a support surface to which a powder image is to be transferred is moved through the equipment at the same rate as the periphery of the drum and contacts the drum at the transfer position interposed between the drum surface and the corona generating device. Transfer is effected by a corona generating device which imparts an electrostatic charge to attract the powder image from the drum to the support surface. The polarity of charge required to effect image transfer is dependent upon the visual form of the original copy relative to the reproduction and the electroscopic characteristics of the developing material employed to effect development. For example, where a positive reproduction is to be made on the positive original, it is conventional to employ a positive polarity corona to effect transfer of a negatively charged toner image to its support surface. When a positive reproduction from a negative original is desired, it is conventional to employ a positively charged developing material which is repelled by the charged areas on the plate to the discharge area thereon to form a positive image which may be transferred by negative polarity corona. In either case, a residual powder image usually remains on the plate after transfer. Before the plate may be reused for a subsequent cycle, it is necessary that the residual image be removed to prevent "ghost images" from forming on subsequent copies and toner film from forming on the photorecoptor surface.

It is also common practice, therefore, to employ a cleaning device which removes from the photoreceptor surface any residual toner material which may have remained on the surface after electrostatic transfer. Several types of cleaning devices are known to the industry, including: soft pads or brushes, flow-type granular cleaners, and soft, flexible polymeric blades.

One such cleaning device, a polyurethane blade, has been used with some success on automatic drum machines. This doctor blade slides on the photoreceptor surface of the drum and pushes or lifts the toner from the surface. This sliding action necessitates the use of a lubricant which will create a lubricating boundary layer between the edge of the blade and the surface. Without this lubricating layer, the high friction between the blade and the surface causes the cleaning edge to stick and roll over into a curled position. Absence of the lubricating layer also results in blade chatter. Both the curled blade and blade chatter create a condition wherein portions of the blade are lifted from the photoreceptor surface thereby resulting in a cleaning failure; i.e., the electroscopic toner material is not completely removed. Such failure is evidenced by streaking on subsequent electrophotographic copies or prints.

It is known in the art that small particles of polyvinylidene fluoride, generally spherical in shape, can be employed as the lubricant. Optimum results are obtained with particles having a generally spherical shape because more effective removal of residual toner particles at lower cleaning pressures is achieved, particularly, with a blade cleaning system. Further, the formation of lubricant films on the photoreceptor during the cleaning operation is inhibited when spherical polyvinylidene fluoride particles are employed due, apparently, to the ball bearing characteristics of the spherical shape. Generally, the particles should have an average size less than about the particle size of the toner particles. An average particle size from about 0.05 to about 16 microns is preferred because at least a portion of the particulate solids tend to collect at the photoconductor-toner interface and enhance the cleaning. Optimum results are obtained with an average particle size range from about 0.5 micron to about 2.5 micron because efficient cleaning is achieved without adversely affecting image density as a result of particles present in transferred toner images.

Some difficulties, however, have been encountered with the use of particulate polyvinylidene fluoride as a lubricant in electrophotographic developer compositions. It is believed that these difficulties derive from the fact that polyvinylidene fluoride is composed of both amorphous and crystalline regions. The amorphous content of the material is relatively high (40–60%), and it exists as a mobile, low viscosity melt (Glass Transition Temperature, Tg approximately −50° C). This amorphous phase not only acts as a plasticizer lowering the potential modulus of the material, but may also act as a tacky binder helping to impact the particles to the carrier beads. This impaction of the polyvinylidene fluoride on the exterior surfaces of the carrier particles adversely affects the carrier's triboelectric properties, which in turn results in poor electrophotographic prints characterized by fuzzy images and clouded background.

SUMMARY OF THE INVENTION

It has been found that an improved electrophotographic developer composition results where the lubricant utilized is a particulate, cross-linked polyvinylidene fluoride. The polyvinylidene fluoride is cross-linked by exposure to a relatively small dosage of high energy ionizing radiation whereby its dimensional stability is improved. When this improved lubricant is incorporated in a cascade developer composition and used in the electrophotographic process it appears to more readily maintain its spherical shape and resist impaction on the carrier vehicle.

DETAILED DESCRIPTION OF THE INVENTION

The present invention is directed toward the use of cross-linked polyvinylidene fluoride as a particulate lubricant in an electrophotographic developer composition. It has been found that cross-linking the polyvinylidene fluoride by exposure to a small dosage of high energy ionizing radiation enhances the dimensional stability of the particulate lubricant. Dimensional stability in this context is intended to mean the ability of the lubricating particles to maintain their original spherical shape and size under the conditions experienced in the automatic electrophotographic process. This qualitative improvement in the dimensional stability of the particulate lubricant represents a complex interplay of many specific physical properties. Neither the exact cross-linking reaction nor the resulting effects on the particles' physical properties is completely understood. However, it is known that when the polyvinylidene fluoride is exposed to a small dosage of high energy ionizing radiation its tendency to deform, or impact on the carrier vehicle, or agglomerate appears to be inhibited. It is believed that light cross-linking of the polyvinylidene fluoride immobilizes the amorphous regions therein without destroying the mechanical properties of the crystalline regions, and, thus, improved dimensional stability results.

The term "small dosage" of radiation is intended to mean an amount in the range from about 0.7 to about 10.0 megarads. Preferably, the polyvinylidene fluoride lubricant is exposed to between about 1.0 and 2.0 megarads of high energy ionizing radiation, since in this range optimum dimensional stability appears to be achieved. At higher dosage levels (above 5 megarads) particle deformation and agglomeration appear to gradually increase, and at higher dosage levels (50 megarads and greater) some serious deterioration of the polyvinylidene fluoride particles appears to occur.

According to the present invention, the lightly cross-linked lubricating particles are added to the particulate carrier vehicle and the electroscopic toner in an amount to provide from 0.3 to 5.0 percent by weight of the toner and, preferably, from 0.7 to 2.2 percent by weight of toner. Use of less than 0.3 percent by weight of toner results in ineffective lubrication between the cleaning blade and the photoreceptor surface whereby cleaning malfunctions will increase. Whereas, incorporation of greater than 5.0 percent by weight of the toner will result in degradation of the triboelectric relationship of the particulate carrier vehicle and the electroscopic toner, which relationship is critical in the electrophotographic process.

In accordance with this invention samples of particulate polyvinylidene fluoride were evenly spread on metal trays. The trays were water-cooled to reduce any possibility of heating effects. The particulate polyvinylidene fluoride was then passed through a beam of high energy electrons with a sufficient penetration depth to irradiate all of the particles. The radiation dosage for the different samples was varied from 0.2 to 56.0 megarads, and after irradiation the polyvinylidene fluoride was stored for approximately 24 hours to allow for delayed free-radical reactions. The irradiated polyvinylidene fluoride particles were then tumbled with a particulate carrier vehicle (polymer coated 250 micron steel shot) for 12 minutes. This testing procedure was utilized in order to simulate the actual development system, since this was considered the most reliable method of evaluating the effect of high energy irradiation on the polyvinylidene fluoride lubricant within the context of the present invention.

A Scanning Electron Microscope was then used to examine the sample mixtures after tumbling to determine the dimensional stability of the irradiated polyvinylidene fluoride particles and the degree to which they impacted on the surface of the carrier vehicle.

There was no observable difference in the shape or impaction of untreated polyvinylidene fluoride and polyvinylidene fluoride irradiated at dosage levels of 0.2 to 0.4 megarads. However, at a dosage of 0.7 megarads, and higher, there was an observable improvement in dimensional stability. The radiation dosage of between about 1.0 and 2.0 megarads proved to be particularly beneficial, since at these levels the cross-linked polyvinylidene fluoride lubricating material exhibited substantially improved dimensional stability and demonstrated less tendency to agglomerate on the carrier surfaces. However, as irradiation dosages were increased above 5 megarads to higher levels there was a gradual deterioration in dimensional stability. The reason for this deterioration is not clearly understood. However, it can be hypothesized that at the higher irradiation levels the cross-linking of the material affects not only the amorphous regions but also the crystalline regions and in a manner which is detrimental to physical properties.

The improved electrophotographic developer composition of this invention will prove effective in those electrophotographic processes employing a doctor blade cleaning device since the cross-linked polyvinylidene fluoride will provide the necessary lubricating layer between the blade and the photoreceptor surface. Furthermore, this improved developer composition should provide the further benefit of a longer usefull work life because of the reduce affinity of cross-linked polyvinylidene fluoride for impaction on the carrier vehicle.

It should be understood that various modifications of the preferred embodiments of the improved electrophotographic developer composition as discussed herein can be effected without departing from the spirit and scope of the invention.

We claim:

1. In a developer composition for use in automatic electrophotographic machines, said composition comprising a particulate free-flowing carrier vehicle, an electroscopic toner material and a particulate polyvinylidene fluoride lubricant having an average particle size less than that of the toner material, the improvement comprising:

said particulate polyvinylidene fluoride being cross-linked by high energy ionizing irradiation in the range of about 0.7 to 10 megarads, whereby the dimensional stability of said particulate lubricant is upgraded.

2. A developer for use in developing electrostatic charge patterns comprising a mixture of:

a. particulate free-flowing carrier vehicle, b. electroscopic toner material and c. particulate, cross-linked, polyvinylidene fluoride having an average particle size less than the size of the toner material in an amount to provide from about 0.3– 5.0 percent by weight based on the weight of said toner material where said particulate polyvinylidene fluoride is cross-linked by high energy, ionizing radiation in the range of about 0.7 to 10 megarads.

3. The developer composition of claim 1 wherein said particulate polyvinylidene fluoride is cross-linked by high energy, ionizing radiation in the range of about 0.7 to 5.0 megarads.

4. The developer composition of claim 1 wherein said polyvinylidene fluoride is cross-linked by between about 1 and 2 megarads of high energy ionizing radiation.

5. The developer composition of claim 4 wherein said polyvinylidene fluoride is present in said mixture in an amount to provide from about 0.7–2.2 percent by weight based on the weight of said toner material.

* * * * *